US007942108B2

(12) United States Patent
Sherrod

(10) Patent No.: US 7,942,108 B2
(45) Date of Patent: May 17, 2011

(54) NOISEMAKER PENNANT

(76) Inventor: Katherine R. Sherrod, Norfolk, VA (US)

( * ) Notice: Subject to any disclaimer, the term of this patent is extended or adjusted under 35 U.S.C. 154(b) by 451 days.

(21) Appl. No.: 12/219,283

(22) Filed: Jul. 18, 2008

(65) Prior Publication Data

US 2008/0282960 A1 Nov. 20, 2008

Related U.S. Application Data

(63) Continuation-in-part of application No. 11/642,649, filed on Dec. 21, 2006, now abandoned.

(51) Int. Cl.
*G09F 17/00* (2006.01)

(52) U.S. Cl. ..... 116/173; 116/2; 40/218; 446/81; 446/404

(58) Field of Classification Search ..... 446/81, 446/213, 265, 397, 404, 415, 418–422; 116/173, 116/2; 40/218; D11/165, 181
See application file for complete search history.

(56) References Cited

U.S. PATENT DOCUMENTS

| | | | | | |
|---|---|---|---|---|---|
| 182,410 | A | * | 9/1876 | Brown | 116/2 |
| 1,033,187 | A | * | 7/1912 | Metzger | 285/87 |
| 1,036,168 | A | * | 8/1912 | Updike | 116/173 |
| 1,711,309 | A | | 4/1929 | Escovar | |
| 2,855,890 | A | * | 10/1958 | Sprenger et al. | 116/173 |
| 2,968,890 | A | * | 1/1961 | De Nisco | 446/216 |
| 3,762,360 | A | | 10/1973 | Hawes | |
| D263,815 | S | | 4/1982 | Ornatek | |
| D264,064 | S | | 4/1982 | Ornatek | |
| D264,571 | S | | 5/1982 | Ornatek | |
| D265,072 | S | | 6/1982 | Ornatek | |
| D265,073 | S | | 6/1982 | Ornatek | |
| D265,077 | S | | 6/1982 | Ornatek | |
| D265,078 | S | | 6/1982 | Ornatek | |
| D265,079 | S | | 6/1982 | Ornatek | |
| D265,389 | S | | 7/1982 | Ornatek | |
| D265,473 | S | | 7/1982 | Ornatek | |
| 4,454,204 | A | | 6/1984 | Posey | |
| 4,976,651 | A | | 12/1990 | Frank | |
| 5,045,017 | A | * | 9/1991 | Masson | 446/415 |
| D326,432 | S | | 5/1992 | McNulty | |

(Continued)

OTHER PUBLICATIONS

Website http://cgi.ebay.com/ws/eBayISAPI.dll?ViewItem &item=150057714986&ih=category=39721 &ssPageName=STORE:PROMOBOX:NEWLIST, Democratic Party Donkey Flag, three sheets printed from the Internet on Nov. 15, 2006.

(Continued)

*Primary Examiner* — Gene Kim
*Assistant Examiner* — Scott Young
(74) *Attorney, Agent, or Firm* — Richard C. Litman

(57) ABSTRACT

The noisemaker pennant is a combination pennant or flag and a noisemaker device that enables the sports fan to simultaneously express his or her emotions at an event both visually and audibly. Waving the present noisemaker pennant serves to display the pennant or flag thereon, while simultaneously activating the noisemaker device attached thereto. The noisemaker pennant may have various types of pennants, flags, banners, etc. formed of relatively thin, flexible material, with a sports team logo, player's name, political symbol, etc., displayed thereon. The noisemaker portion may be any of various devices, including, but not limited to, clappers, ratcheting devices, bells, whistles, etc. The noisemaker portion and/or the pennant may be removably secured to the staff, to allow the user to interchangeably install different noisemakers with the pennant or flag. A handgrip is provided on the staff opposite the noisemaker end thereof.

11 Claims, 8 Drawing Sheets

U.S. PATENT DOCUMENTS

| | | | | | |
|---|---|---|---|---|---|
| 5,115,472 | A | * | 5/1992 | Park et al. | 381/152 |
| 5,115,756 | A | * | 5/1992 | Maffei | 116/2 |
| 5,246,517 | A | | 9/1993 | Watson | |
| 5,343,825 | A | * | 9/1994 | Gazecimeon et al. | 116/173 |
| D360,843 | S | * | 8/1995 | Harris | D10/109 |
| 5,483,916 | A | | 1/1996 | Kolvites et al. | |
| D378,384 | S | | 3/1997 | Gilbert, Jr. et al. | |
| 5,671,480 | A | | 9/1997 | Krout et al. | |
| 5,682,615 | A | | 11/1997 | Wahl et al. | |
| D390,887 | S | | 2/1998 | Gilbert, Jr. et al. | |
| 5,740,622 | A | | 4/1998 | Martin | |
| 5,862,773 | A | | 1/1999 | Kaufman | |
| 5,873,766 | A | | 2/1999 | Burton | |
| 5,899,167 | A | | 5/1999 | Furman | |
| 5,933,081 | A | | 8/1999 | Jones | |
| 5,984,761 | A | | 11/1999 | Kalinowski | |
| D422,529 | S | | 4/2000 | Watts, Jr. | |
| 6,086,448 | A | | 7/2000 | Ibanez | |
| 6,293,684 | B1 | * | 9/2001 | Riblett | 362/184 |
| 6,302,813 | B1 | | 10/2001 | Sturgeon | |
| 6,331,131 | B1 | | 12/2001 | Selevan | |
| 6,736,695 | B1 | * | 5/2004 | Hoch | 446/397 |
| 6,817,922 | B1 | | 11/2004 | Davies | |
| 7,100,529 | B2 | * | 9/2006 | Hlavin | 116/173 |
| 7,343,636 | B1 | * | 3/2008 | Castillo | 5/653 |
| 7,367,148 | B2 | * | 5/2008 | Moody | 40/610 |
| 7,572,966 | B1 | * | 8/2009 | Frigo et al. | 84/402 |
| 7,607,960 | B2 | * | 10/2009 | Kobayashi | 446/421 |

OTHER PUBLICATIONS

Website http://www.flagsbannersonline.com/elephant1.html, Elephant Flag, one sheet printed from the Internet on Nov. 15, 2006.

* cited by examiner

NOISEMAKER PENNANT

REFERENCE TO RELATED PATENT APPLICATION

This application is a continuation-in-part of U.S. Utility patent application Ser. No. 11/642,649 filed on Dec. 21, 2006 now abandoned.

BACKGROUND OF THE INVENTION

1. Field of the Invention

The present invention relates generally to novelty signaling devices and the like, and more particularly to a noisemaker pennant for use at sports events and conventions and the like.

2. Description of the Related Art

It has been customary for years for ardent sports fans to express their emotions at various sports competitions. This is typically accomplished by applauding, cheering, and/or otherwise expressing one's emotions when a particularly desirable result occurs on the playing field, track, etc. In many instances, fans will purchase a pennant or the like to wave while cheering their favorite player or team on.

It is customary for many fans to cheer or otherwise express their feelings audibly for their team or player, perhaps while simultaneously waving a banner, flag, etc. In many instances, fans show their pleasure by applauding a particularly good play or other favorable situation or result on the field. However, it is impossible to use one's hands to applaud while simultaneously waving a flag, pennant, banner, or some other visual device, particularly if some form of food or refreshment, or perhaps a program or other article, is being held in the other hand as well. Much the same is true at various conventions and similar gatherings, when participants wish to express their appreciation of a speaker, activity, etc.

Thus, a noisemaker pennant solving the aforementioned problems is desired.

SUMMARY OF THE INVENTION

The noisemaker pennant is a pennant, flag, banner, or the like in combination with a noisemaking device, e.g., a "clapper" type device, ratcheting or rattling noisemaker, bell, etc. The noisemaker pennant enables the sports fan to root for his or her team simultaneously using both visual means by waving the pennant or banner and audio means by shaking, turning, or otherwise operating the attached sound-producing device. The flag or pennant portion of the noisemaker pennant may comprise any of a number of different forms, so long as the pennant is a relatively lightweight, thin, and flexible material adapted to be waved and displayed in such a manner. It will be understood that the term "pennant" as used herein, includes flags, banners, and similar devices having sports team logos, athletes' or participants' names, numbers, teams, etc. thereon, symbols common to and recognized in the sport or other activity, political logos and symbols, etc., as desired.

The noisemaker portion of the device may comprise any of a number of different manually actuated devices (bells, clappers, ratcheting or other types of noisemakers, whistles, etc.). The noisemaking device is secured to the opposite end of the staff from the handgrip or handle portion, and produces a sound whenever it is shaken, spun, rotated, or otherwise vigorously moved simultaneously with waving or other movement of the pennant on the same staff. A handgrip is preferably provided along the staff, opposite the noisemaker end of the staff.

Preferably, the noisemaker is detachably secured to the staff for removal and replacement. This allows the owner or user of the device to exchange the noisemaker portion in order to install different types of noisemakers on the end of the staff for use with different pennants. The noisemaker pennant provides various means of temporarily and removably securing a variety of noisemaking devices to the end of the pennant staff. Alternatively, the pennant may be removably secured to the staff for interchange of different pennants.

In at least one embodiment, the staff is formed as a translucent, hollow, elongate structure. It is divided longitudinally into two halves, with the edges of the halves along the pennant attachment area being equipped with a large number of fine teeth. The base portion of the pennant is gripped by the teeth in the assembled device. One or more lights (e.g., light emitting diodes, LEDs) are installed within the hollow translucent staff, with at least one battery and an electrical switch provided to actuate the LEDs selectively as desired for night events or venues with low levels of lighting.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
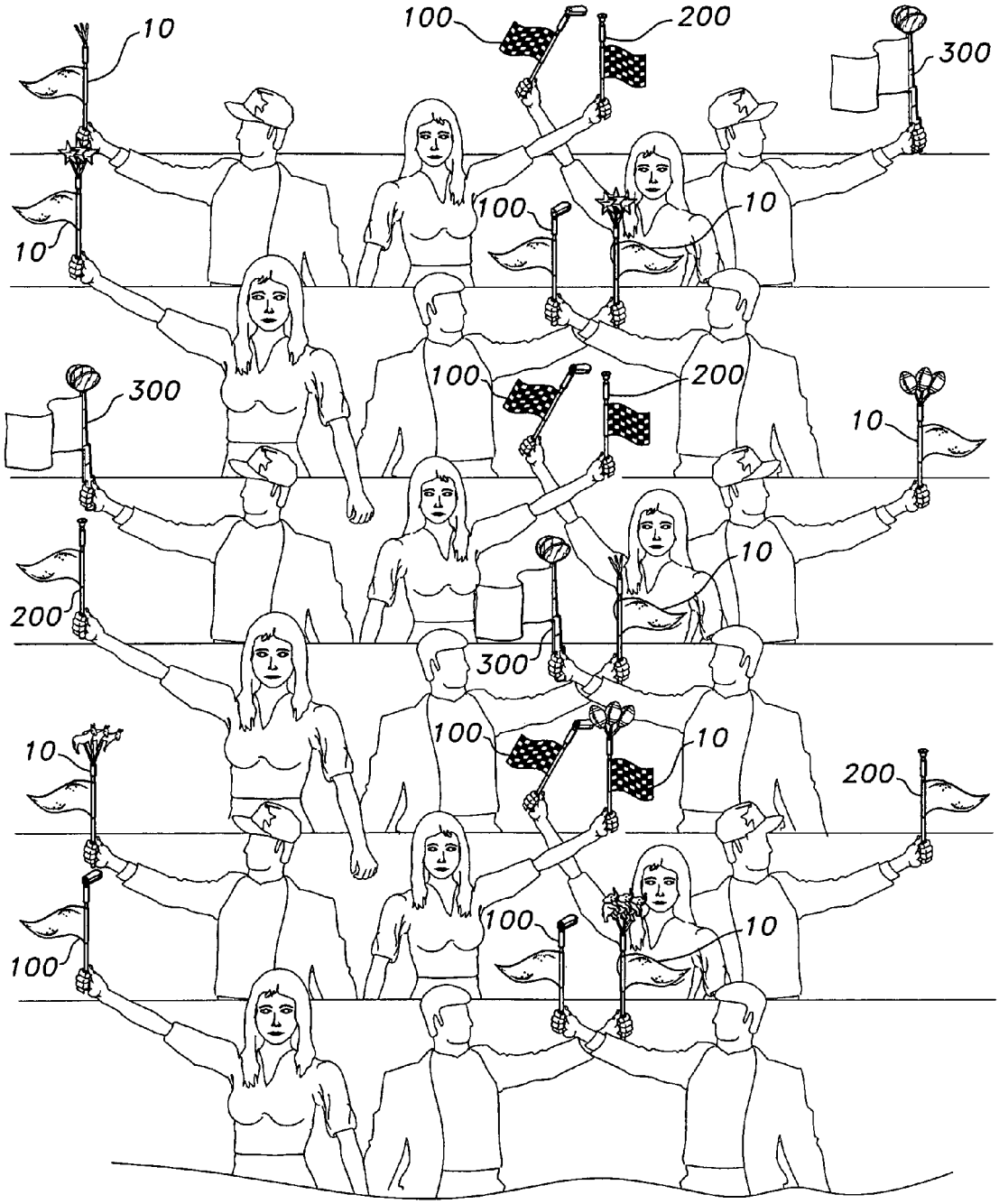
FIG. 1 is an environmental view showing a large number of fans waving and using various embodiments of a noisemaker pennant according to the present invention in a stadium environment.

The present invention comprises various embodiments of a combination noisemaker pennant device for use by fans at sporting events, political conventions, and the like. FIG. 1 of the drawings illustrates a series of different embodiments of the noisemaker pennant in use by fans at a sporting event, with the different embodiments of FIG. 1 respectively designated as noisemaker pennants 10, 100, 200, and 300, which are illustrated in further detail in the following drawings and described in greater detail further below. The noisemaker pennants shown in FIG. 1 are exemplary, and it will be understood that a great number of additional embodiments may be developed in accordance with the teachings of the present invention.

The noisemaker pennant generally comprises a flag, pennant, banner, or the like formed of a relatively lightweight and flexible sheet of material (fabric, plastic sheet, etc.), which is attached to a staff, and a noisemaker device attached to and extending from one end of the staff. Both the pennant and noisemaker may be permanently secured to the staff, but preferably at least the noisemaker component is removably secured to the upper or distal end of the staff so that the user may interchange different noisemaking devices with a given pennant and staff as desired. The pennant or flag portion may also be removably secured to the staff.

Figure 2:
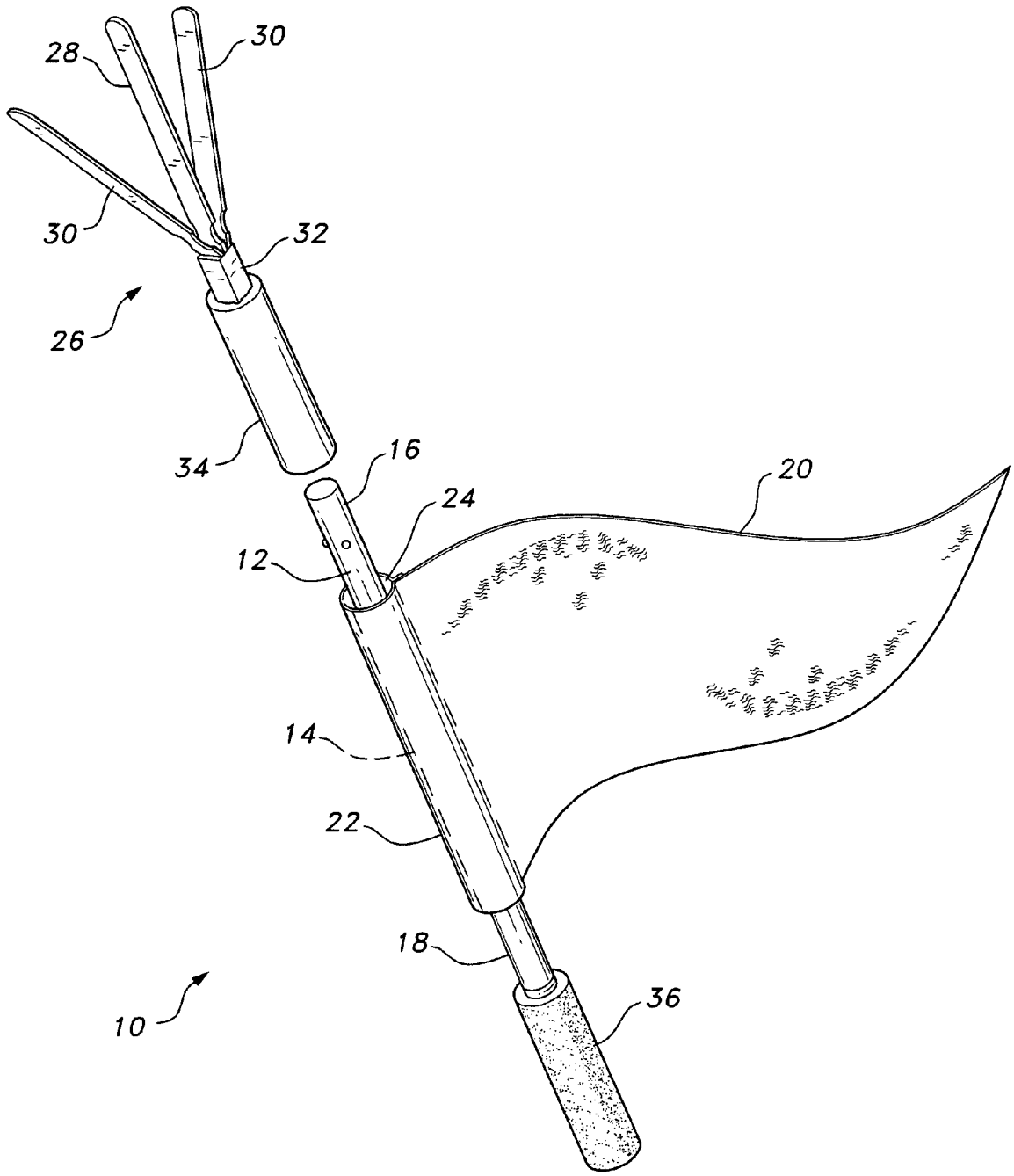
FIG. 2 is an exploded perspective view of a first embodiment of the present noisemaker pennant, illustrating the system used for removably securing the noisemaker device to the staff portion.

FIG. 2 provides a detailed illustration of the noisemaker pennant 10 shown generally in FIG. 1, and illustrates its various components and their interrelationships. The noisemaker pennant 10 comprises an elongate staff 12, which may be formed of wood, plastic rod or tubing, or other suitable material. The staff 12 has a pennant attachment portion 14, which is generally oriented upwardly when the device 10 is in use, and a distal noisemaker attachment end 16 preferably immediately beyond the pennant attachment portion 14, with a central staff portion 18 depending from the pennant attachment portion 14. The central portion 18 need not be excessively long, and in fact the noisemaker and pennant components may extend over or cover nearly all of the staff 12, so that little or none of the central length 18 is visible when the device is assembled in order to provide a compact unit.

A pennant, flag, banner, etc. 20 is secured to the pennant attachment portion 14 of the rod or staff 12. This pennant 20 may comprise any of a number of different configurations (triangular, square, etc.), with any or all of the configurations possibly including some form of indicia thereon, e.g., sports team emblems or logos, player names and numbers, signaling flags used in auto racing, political symbols, etc. As noted further above, it will be understood that the term "pennant," as used herein, is intended to cover any relatively thin, flexible or flaccid sheet of material, which may be applied to the pennant attachment portion 14 of the staff 12 and extend therefrom in order to be waved or displayed by a sports fan or user of the noisemaker pennant 10.

The pennant 20 may be permanently secured to the staff 12, e.g., by conventional staples, adhesive, etc. Alternatively, the pennant 20 may be removably secured to the staff 12. The pennant 20 may have a base or staff attachment end 22 comprising or including a sleeve 24, which is configured to fit closely over the pennant attachment portion 14 of the staff 12. Other removable attachment means, e.g., conventional clips, clamps, snaps, etc., may be provided for attaching the pennant 20 to the staff 12.

A noisemaker 26 is removably attached or secured to the noisemaker attachment end 16 of the pennant rod or staff 12. The noisemaker 26 component of the noisemaker pennant 10 of FIGS. 1 and 2 comprises a "clapper" type device, having a relatively fixed central paddle 28 with a pair of hinged vanes 30 extending to opposite sides thereof. The vanes 30 slap against the central paddle 28 when the noisemaker pennant 10 is waved or oscillated, thereby simultaneously providing a visual display in the form of the waving pennant 20 and an audible component emanating from the noisemaker device 26. Any number of alternative noisemaker devices or configurations may be attached to the staff 12 of the noisemaker pennant 10, depending upon the sound desired, cost objectives, etc. A few such noisemaker alternatives are illustrated in the other embodiments shown in FIG. 1 of the drawings and in subsequent drawings discussed in detail further below.

Figure 3A:
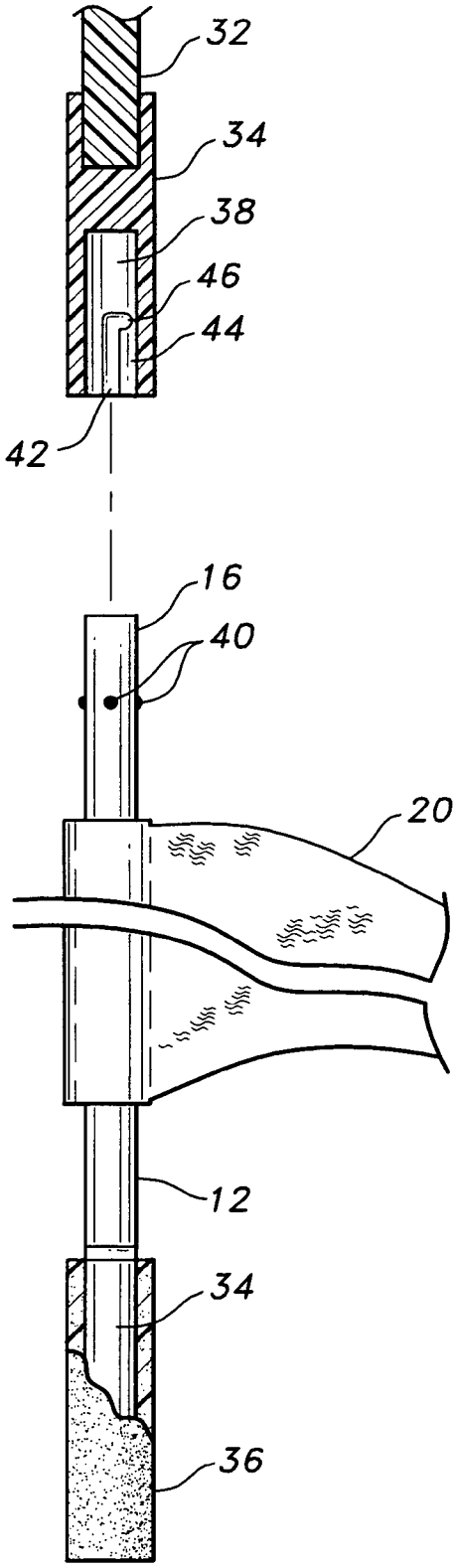
FIG. 3A is an exploded elevation view in partial section of the noisemaker and pennant staff attachment means of the noisemaker pennant of FIG. 2, showing details thereof.

The noisemaker 26 has a base 32 with a generally cylindrical staff attachment portion or end 34 extending axially therefrom. The staff attachment end portion 34 of the noisemaker 26 includes a socket 38 formed therein adapted for the removable installation of the noisemaker attachment end 16 of the pennant staff 12 therein, as shown in FIG. 3A. In the noisemaker pennant 10 of FIGS. 1, 2, and 3A, the noisemaker attachment end 16 of the staff 12 includes at least one protuberance 40 (and preferably a plurality of such protuberances 40) extending radially therefrom. A corresponding slot or slots 42 is formed axially in the inner wall 44 of the staff attachment socket 38, with each of the slots 42 having a circumferential extension 46 at its base to form a generally L-shaped configuration, as shown in detail in FIG. 3A.

The noisemaker 26 is removably secured to the pennant staff 12 by inserting the noisemaker attachment end 16 of the staff 12 into the noisemaker socket 38 with the staff protuberance(s) 40 aligned with the noisemaker socket slot(s) 42, and twisting the staff 12 to engage the protuberance(s) 40 with the right-angled circumferential slot extension(s) 46 at the bottom of each slot 42. Removal of the noisemaker device 26 from the staff 12 is accomplished by reversing the above operation.

Figure 3B:
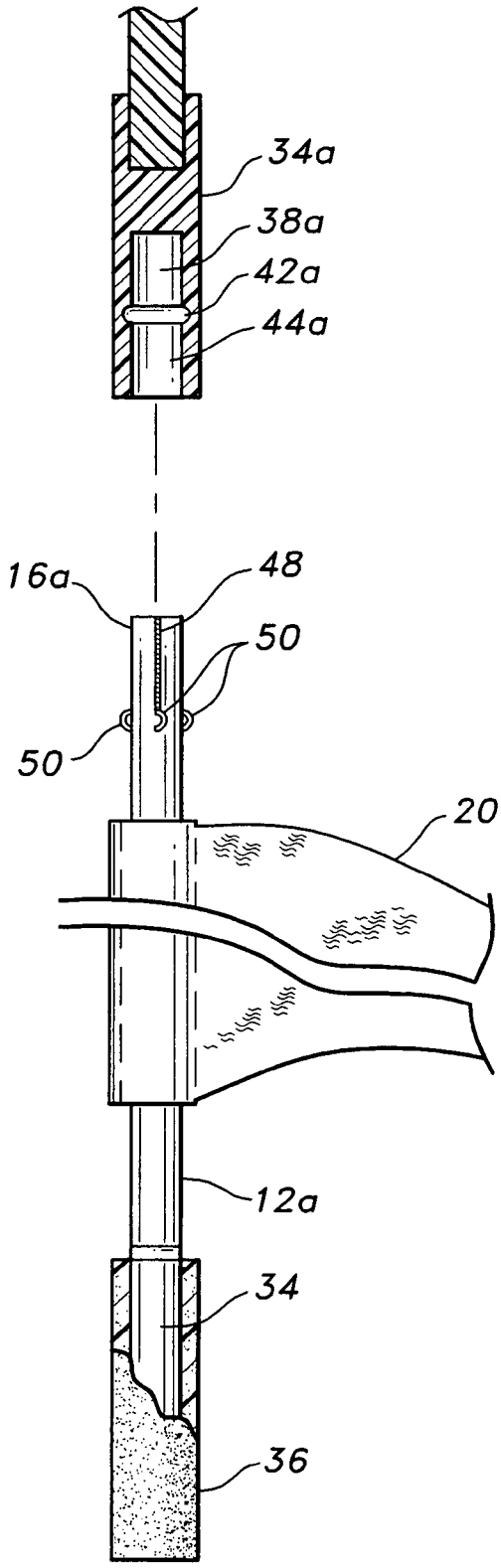
FIG. 3B is an exploded elevation view in partial section of a noisemaker pennant according to the present invention, showing an alternative way of removably securing the noisemaker device to the pennant staff.

FIG. 3B illustrates an alternative means of attaching the noisemaker device to the end of the pennant staff. In FIG. 3B, a pennant staff 12*a* is essentially identical to the staff 12 of FIGS. 2 and 3A, with the exception of the resilient spring element(s) 48 disposed within slots along the noisemaker attachment end 16*a* thereof. These spring element(s) 48 each have a protruding rounded end 50 extending radially from the noisemaker attachment end 16*a* of the staff 12, with the spring 48 urging the end 50 outwardly, similar to devices used to lock telescoping extensions in place in an umbrella. The staff attachment fitting or end 34*a* of the corresponding noisemaker device includes an axial socket 38*a* therein, with the socket 38*a* having a circumferential groove 42*a* formed about its internal wall 44*a*. The spring protrusion(s) 50 and spring element(s) 48 are compressed inwardly by the socket wall 44*a* of the noisemaker attachment fitting 34*a* when the noisemaker attachment end 16*a* of the staff 12*a* is inserted into the noisemaker socket 38*a*, with the spring protrusions 50 expanding or springing radially outwardly to engage the circumferential groove 42*a* of the socket 38*a* when the end 16*a* of the staff 12*a* is fully seated within the noisemaker socket 38*a*. Separation of the staff 12*a* from the noisemaker socket 38*a* is easily accomplished by a moderate pull or tensile force, thereby causing the spring protrusion(s) 50 to be compressed by the interior wall 44*a* of the socket 38*a* to allow the noisemaker attachment end 16*a* of the staff 12*a* to be withdrawn from the noisemaker socket 38*a*.

Figure 4:
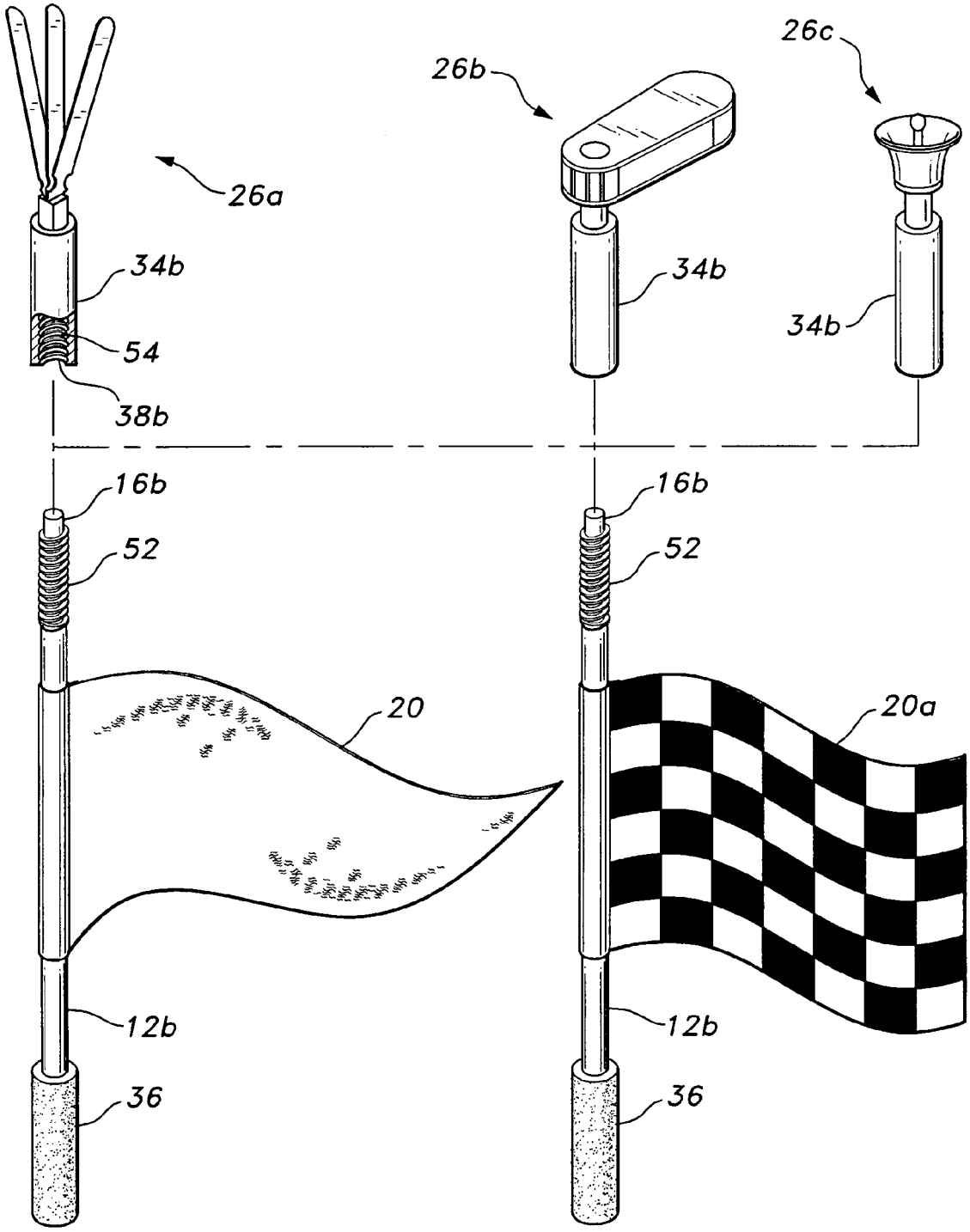
FIG. 4 is an exploded perspective view illustrating the interchangeability of a series of different noisemaker devices with different pennant or flag configurations in a noisemaker pennant according to the present invention.

FIG. 4 of the drawings illustrates further embodiments of the noisemaker pennant, and further illustrates the interchangeability of the various components thereof when the device is provided with compatible attachment means between components. In the left side of FIG. 4, a staff 12*b* includes a pennant 20 extending therefrom, with the noisemaker attachment end 16*b* having external threads 52 thereon. The staff attachment portion 34*b* of the "clapper" type noisemaker 26*a* has a socket 38*b* including internal threads 54 defined therein. The noisemaker 26*a* may thus be threaded onto or removed from the threaded noisemaker attachment end 16*b* of the staff 12*b* to exchange noisemakers.

Any of the various pennant staff and noisemaker components illustrated in FIG. 4 may be assembled with one another in any desired combination due to their common mating threaded attachments. For example, the staff 12*b* illustrated to the right side of FIG. 4 is identical to the staff 12*b* to the left side of FIG. 4, with the only difference being the type of flag or pennant installed thereon. While the left side staff 12*b* has a generally triangular pennant 20 removably or permanently secured thereto, the right side staff 12*b* includes a rectangular checkered flag 20*a*, as used to indicate the end of an auto race, installed thereon. The two different pennants and flags 20 and 20*a* may be interchangeably installed upon either of the flag or pennant staffs 12*b*, or upon the staffs 12 or 12*a* of other drawings, if so desired.

Similarly, the different types of noisemaker devices illustrated in the upper portion of FIG. 4 may be removably secured to either of the pennant or flag staffs 12*b* of FIG. 4. Each of the different noisemakers includes a staff attachment component 34*b* extending therefrom, with each staff attachment including a socket 38*b* having internal threads 54 therein (as shown for the clapper type noisemaker 26*a* to the left side of FIG. 4) to attach to the mating threads 52 of either of the staffs 12*b* of illustrated in FIG. 4. However, a different type of noisemaker extends from each of the identical noisemaker attachment elements 34*b*. The noisemaker 26*a* to the upper left portion of FIG. 4 is a "clapper" type, as discussed further above. The noisemaker 26*b* in the upper center of FIG. 4 comprises a rotating ratchet type device, which produces a noise when rotated or spun. Alternatively, the noisemaker 26*c* to the upper right of FIG. 4 comprises a bell. It will be seen that other types of noisemakers (e.g., whistles, electronic devices, etc.) may be removably or permanently secured to any of the staff components and associated flags or pennants merely by providing mating attachment means between the noisemaker device and corresponding flag or pennant staff. Any of the staffs 12, 12*a*, or 12*b* of FIGS. 1 through 4 may also include a padded or resilient handgrip 36 disposed upon the handle portion 34 thereof (shown in FIGS. 3A and 3B) opposite the noisemaker attachment end 16, 16*a*, or 16*b*.

Figure 5A:
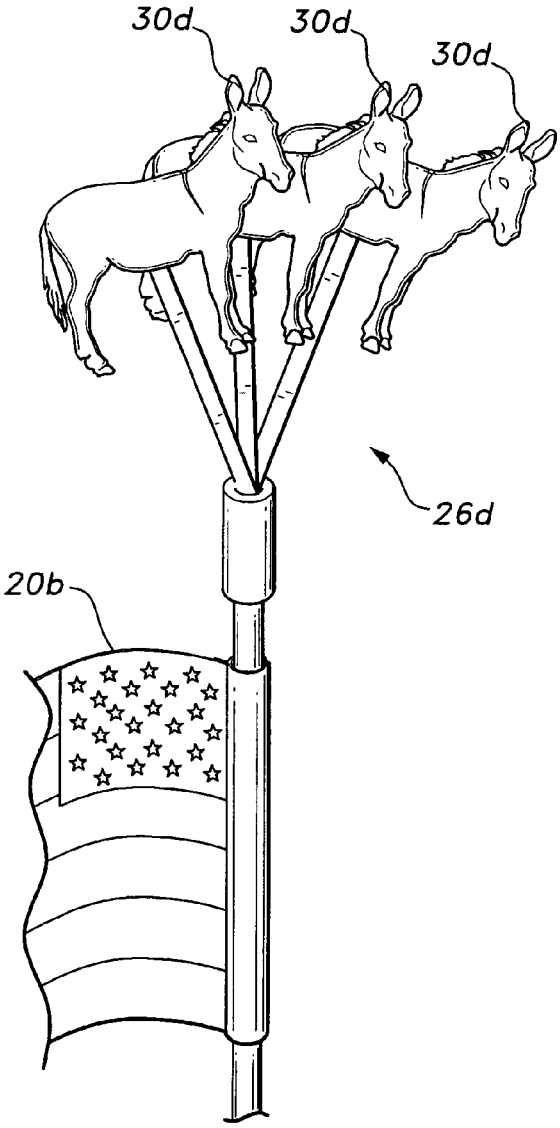
FIGS. 5A, 5B, 5C and 5D illustrate four different clapper-type noisemaker configurations disposed upon the noisemaker installation end of a staff of a noisemaker pennant according to the present invention.
Figure 5B:
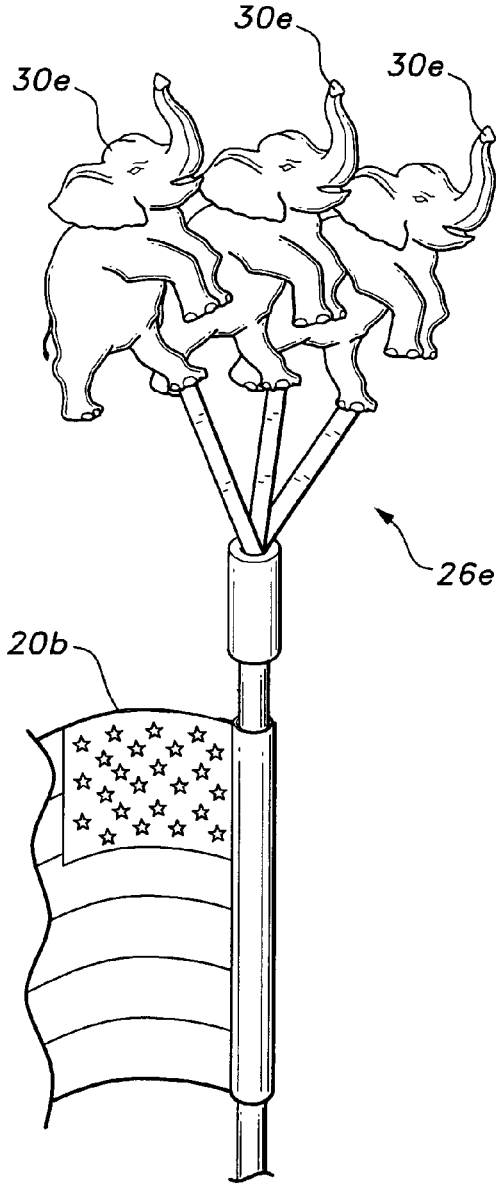

The noisemaker pennant may be used to show support in various other activities, such as political rallies and conventions, as well as at sporting events, as noted further above. FIGS. 5A through 5D provide illustrations of exemplary noisemaker and pennant configurations that might be popular at such events. For example, the clapper type noisemaker device 26*d* of FIG. 5A is similar to the clapper noisemaker 26 and 26*a* respectively of FIGS. 2 and 4, but includes vanes 30*d* configured to resemble the donkey symbolizing the Democratic party. Conversely, the clapper noisemaker 26*e* of FIG. 5B may comprise vanes 30*e* configured to represent the elephant of the Republican Party.

Figure 5C:
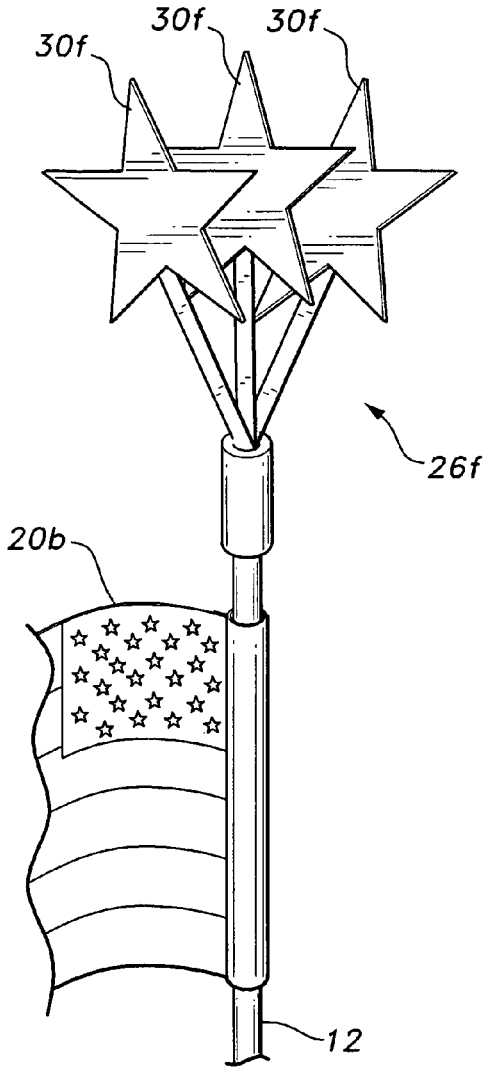
Figure 5D:
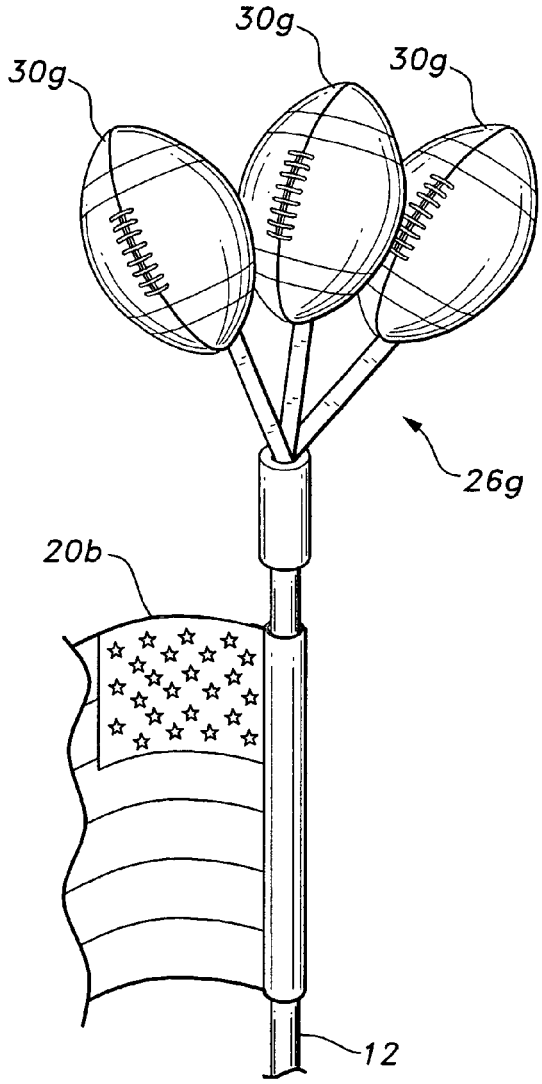

FIGS. 5C and 5D illustrate still further examples of such clapper type noisemaker configurations. In the example of FIG. 5C, the clapper noisemaker 26*f* has clapper elements 30*f* comprising five pointed stars, while the noisemaker 26*g* of FIG. 5D has clapper elements 30*g* resembling American footballs. It will be seen that the specific shape or configuration of the clapper elements may be formed in any practicable manner desired to represent a political party or other organization, sports team or symbol, etc. In a like manner, the flag or pennant disposed upon the staff 12 (or other staff, depending upon the noisemaker attachment principle) may be any practicable configuration or design. In the examples of FIGS. 5A through 5D, an American flag 20*b* is shown.

Figure 6:
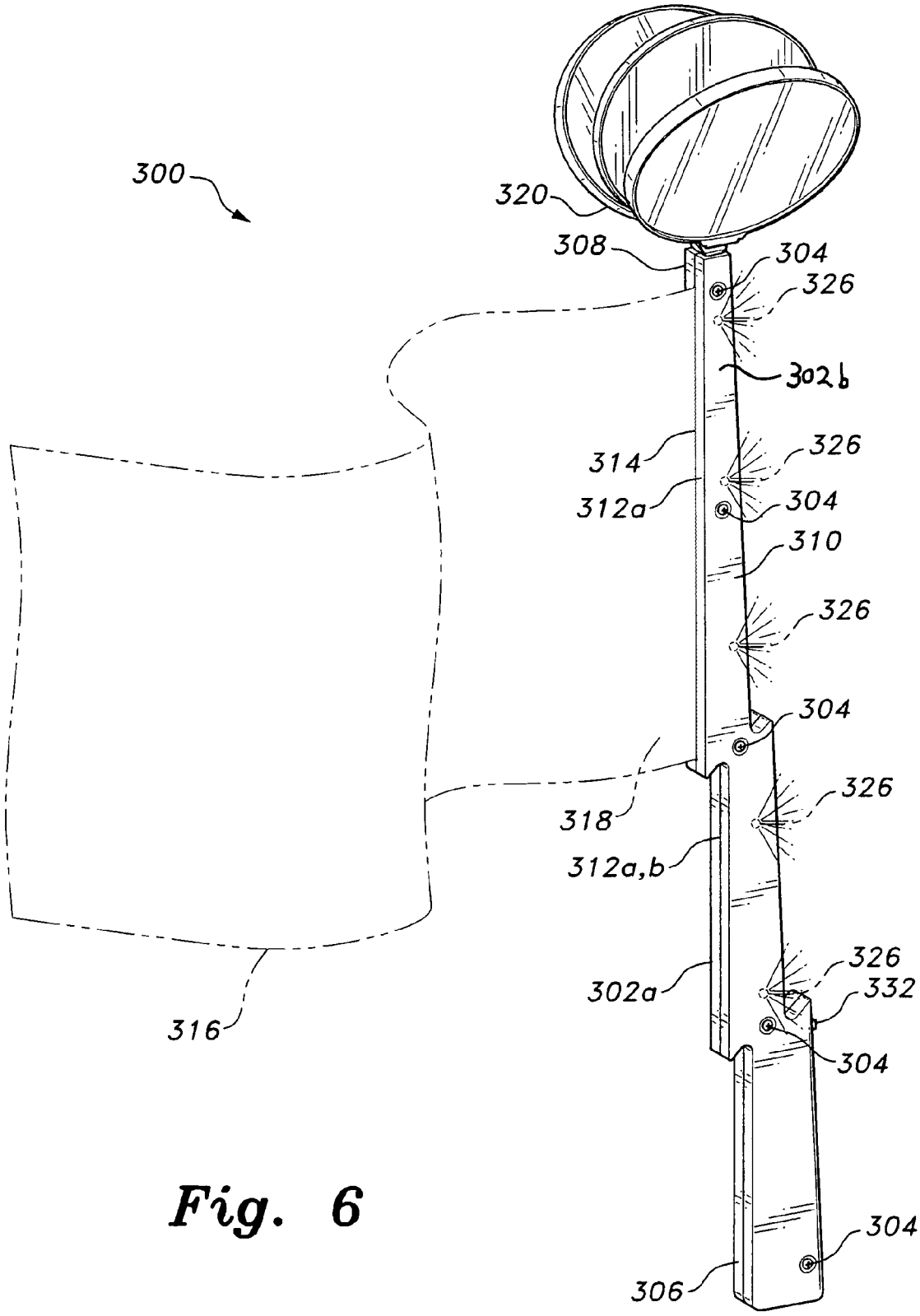
FIG. 6 is a detailed perspective view of an embodiment of a noisemaker pennant according to the present invention having a lighted staff.
Figure 7:
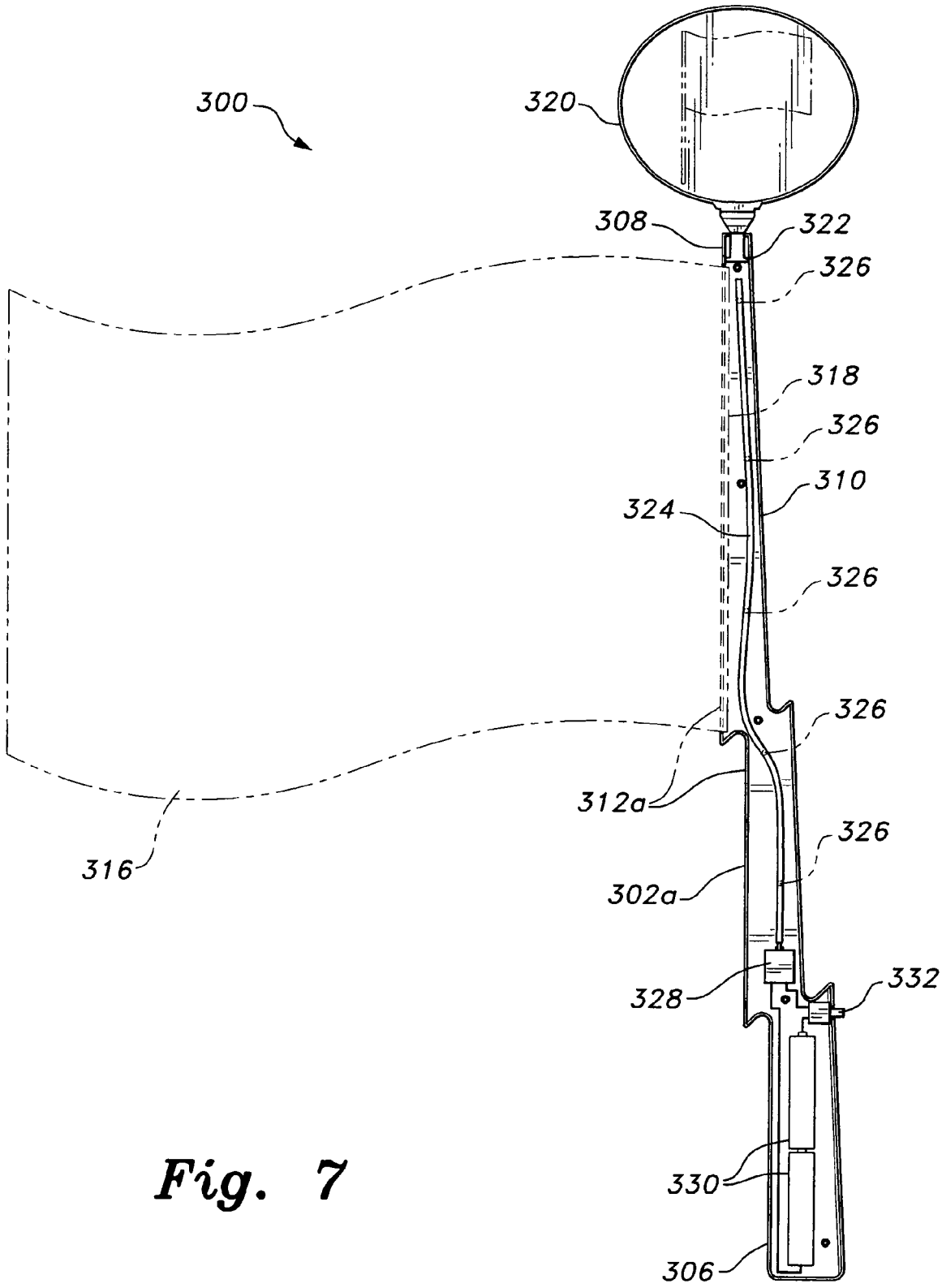
FIG. 7 is a detailed side elevation view in section of the noisemaker pennant of FIG. 6, showing internal details thereof.

FIGS. 6 and 7 of the drawings illustrate a lighted noisemaker pennant 300 that is well suited for expressing the emotions of fans at a nighttime sports activity, game, political rally, or the like. The lighted noisemaker pennant 300 includes an elongate, hollow staff formed of two longitudinally divided translucent halves 302*a* and 302*b*. The two staff portions 302*a*, 302*b* are assembled by a series of screws 304 extending through the first portion 302*a* and threaded into internal bosses in the second portion 302*b*. Other fasteners may be used to join the two halves together, if desired.

The staff assembly 302*a*, 302*b* is configured generally like the staffs of the other embodiments 10, 100, and 200, i.e., having a handle portion 306, an opposite noisemaker attachment end 308, and a pennant attachment portion 310 adjacent the noisemaker attachment end 308. Each of the mating edges 312*a*, 312*b* of the two staff portions 302*a*, 302*b* includes a series of preferably relatively fine pennant gripping teeth 314 disposed along the pennant attachment portion 310 thereof, as shown along the edge 312*a* of staff portion 302*b* in FIG. 6. The thin, flexible pennant 316 has a base portion 318 clamped between the two staff portions 302*a*, 302*b*, with the gripping teeth 314 clasping the pennant base 318 securely therebetween when the two staff portions 302*a*, 302*b* are assembled together. The pennant base 318 may include a stitched sleeve therealong, or other doubling or thickening of the pennant base material, with the thickened material being captured within the hollow interior of the staff 302*a*, 302*b* to preclude the pennant 316 from being pulled from its attachment to the staff.

The pennant attachment portion 310 of the staff preferably extends to a point immediately adjacent the noisemaker attachment end 308 of the staff. Thus, the upper edge of the pennant 316, i.e., the edge opposite the handle portion 306 of the staff, is preferably located immediately adjacent the noisemaker attachment end 308. A noisemaker, e.g., a clapper 320, is attached to, and extends from, the noisemaker attachment end 308 of the staff. The clapper 320 has a configuration generally like the clapper devices illustrated in FIGS. 2 and 5A through 5D, i.e., a fixed central paddle with opposite movable vanes hinged to each side thereof.

The clapper 320, however, may have any clapper configuration, or the noisemaker pennant 300 may have any other noisemaker configuration (e.g., bell, rotating ratchet, etc.) compatible with the noisemaker attachment end 308 of the staff 302*a*, 302*b*. In the example of FIGS. 6 and 7, the clapper noisemaker 320 has a widened protrusion 322 at its base that is captured within the hollow noisemaker attachment end 308 of the assembled staff portions 302*a*, 302*b*. The outwardly facing paddles of the clapper 320 may be decorated or embellished with any practicable logo, design, or the like, e.g., an American flag, political party symbols, team logos and/or colors, etc.

FIG. 7 illustrates the lighting system used with the lighted noisemaker pennant 300. While the staff portions 302*a*, 302*b* may enclose a single light, preferably a string 324 of small lights 326 is installed within the length of the hollow staff assembly. The lights 326 are preferably light emitting diodes (LEDs), due to their advantageous size, power consumption, and lack of emitted heat. However, other lighting devices may be used, if desired. A small solid state controller or LED driver 328 is enclosed within the staff, with one or more electrical cells 330 providing electrical power to the circuit through a selectively actuated switch 332. The staff 302*a*, 302*b* is preferably shaped or configured to resemble a symbolic lightning stroke, as shown in FIGS. 1, 6, and 7, to symbolize the power of such a phenomenon. Accordingly, the LEDs or other lights 326 may be made to flash randomly or in a predetermined pattern by the controller or driver 328, as desired, to show through the translucent material of the staff portions 302*a* and 302*b*.

In conclusion, the noisemaker pennant provides an enjoyable means for a sports fan to express his or her emotions at a sporting event or the like, or for a participant at a political event to show his or her support. The fan or participant may purchase or modify the associated pennant, flag, banner, etc. to display his or her favorite team emblem, logo, player name and/or number, political party or affiliation, etc. The inclusion of a noisemaking device with the flag or pennant staff allows the fan or participant to produce a sound while simultaneously waving the flag or banner (and perhaps activating the lighting therein, if so equipped) to express himself or herself visually. The great versatility of the noisemaker pennant with its ability to provide different sounds depending upon the type of noisemaking device installed therewith, will thus find great favor among sports fans and participants in various events everywhere.

It is to be understood that the present invention is not limited to the embodiments described above, but encompasses any and all embodiments within the scope of the following claims.

I claim:

1. A noisemaker pennant, comprising:

a hollow, translucent, elongate staff having a noisemaker attachment end, a handle portion opposite the noisemaker attachment end, and a pennant attachment portion adjacent the noisemaker attachment end, the staff is divided longitudinally throughout substantially its entire length thereby forming a symmetrical first half and a second half, each half having a mutually facing edge, wherein the edge of the pennant attachment portion of each half of the staff has a plurality of pennant gripping teeth disposed therealong;

a pennant formed of a thin, flexible sheet of material attached to, and extending from, the pennant attachment portion of the staff, wherein the pennant has a base portion clasped between the teeth of the pennant attachment portion of each half of the staff;

a noisemaker device attached to, and extending from, the noisemaker attachment end of the staff; and at least one selectively operable light disposed within the hollow, translucent, elongate staff and located within the pennant attachment portion.

2. The noisemaker pennant according to claim 1, further including a resilient handgrip disposed upon the handle portion of said staff.

3. The noisemaker pennant according to claim 1, wherein said noisemaker device is removably attached to the noisemaker attachment end of said staff.

4. The noisemaker pennant according to claim 3, wherein said noisemaker device has a staff attachment socket formed axially therein, the socket including an internal wall having at least one L-shaped slot formed therein, the noisemaker pennant further including at least one protuberance extending radially from the noisemaker attachment end of said staff, the protuberance being slidable in both legs of the L-shaped slot in order to removably attach said noisemaker device to said staff.

5. The noisemaker pennant according to claim 3, wherein said noisemaker device has a staff attachment socket formed axially therein, the socket including an internal wall having a circumferential groove formed therein, the noisemaker pennant further including at least one resilient spring element extending radially from the noisemaker attachment end of said staff, the spring element resiliently engaging the circumferential groove in order to removably attach said noisemaker device to said staff.

6. The noisemaker pennant according to claim 3, wherein said noisemaker device has a staff attachment socket formed axially therein, the socket being internally threaded, the noisemaker attachment end of said staff being externally threaded, whereby said noisemaker device is removably attached to said staff by threading the noisemaker attachment end of said staff into the staff attachment socket of said noisemaker device.

7. The noisemaker pennant according to claim 1, wherein said pennant is formed from sheet material selected from the group consisting of plastic and fabric.

8. The noisemaker pennant according to claim 1, wherein the at least one light comprises a plurality of light emitting diodes.

9. The noisemaker pennant according to claim 1, wherein said noisemaker device is selected from the group consisting of clappers, rotating ratchets, and bells.

10. The noisemaker pennant according to claim 1, wherein each half of the staff includes means for securing the halves together.

11. The noisemaker pennant according to claim 10, wherein the means for securing the halves together includes the first half of the staff having a series of threaded internal bores spaced therealong and the second half of the staff having correspondingly aligned apertures therealong, whereby screw fasteners secure the halves together.

* * * * *